US006261059B1

(12) United States Patent
Wadensten

(10) Patent No.: US 6,261,059 B1
(45) Date of Patent: Jul. 17, 2001

(54) COMPRESSED GAS ACTUATED TURBINE-TYPE VIBRATOR

(76) Inventor: Theodore S. Wadensten, 75 Stillson Rd., Box 8, Wyoming, RI (US) 02898

( * ) Notice: Subject to any disclaimer, the term of this patent is extended or adjusted under 35 U.S.C. 154(b) by 0 days.

(21) Appl. No.: 09/428,958

(22) Filed: Nov. 4, 1999

(51) Int. Cl.[7] ..... F01D 1/02
(52) U.S. Cl. ..... 415/198.1; 415/202
(58) Field of Search ..... 415/198.1, 202, 415/199.2, 203

(56) References Cited

U.S. PATENT DOCUMENTS

| | | | | |
|---|---|---|---|---|
| 518,436 | * | 4/1894 | Wilkinson | 415/198.1 X |
| 852,293 | * | 4/1907 | Pritchard | 415/202 X |
| 1,356,063 | * | 10/1920 | Gosselin et al. | 415/198.1 X |
| 1,415,219 | * | 5/1922 | Carrey | 415/198.1 X |
| 1,419,772 | * | 6/1922 | Sechrist | 415/202 |
| 3,552,878 | * | 1/1971 | Schreiber | 415/209.3 |
| 3,870,292 | | 3/1975 | Wadensten . | |
| 3,932,057 | | 1/1976 | Wadensten . | |
| 4,389,120 | | 6/1983 | Wadensten . | |
| 4,424,718 | | 1/1984 | Wadensten . | |
| 5,314,300 | * | 5/1994 | Gatley, Jr. et al. | 415/119 |
| 5,314,305 | | 5/1994 | Fink . | |

* cited by examiner

*Primary Examiner*—John E. Ryznic
(74) *Attorney, Agent, or Firm*—Patrick J. Pinto

(57) ABSTRACT

A compressed gas or pneumatically actuated turbine-type vibrator having an outer housing 12, a rotor assembly 14 that is freely rotatable within a cylindrical chamber 16 formed in the outer housing 12. The rotor assembly 14 includes a plurality of V-shaped blades for driving the rotor assembly when and as a propelling surface 36 of the rotor assembly is acted upon by a compressed gas flowing through an inlet port to and towards the propelling surface 36. The outer housing further includes at least one exhaust port for exhausting spent gas from the cylindrical chamber. The V-shaped blade members provide an efficient use of the compressed gas for the vibratory forces developed.

12 Claims, 3 Drawing Sheets

COMPRESSED GAS ACTUATED TURBINE-TYPE VIBRATOR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

With regard to the classification of art, this invention is believed to be found in the general class pertaining to vibrators and more particularly to those subclasses pertaining to turbine-type vibrators that are operated by a compressed gas.

2. Description of Related Art Including Information Disclosed Under 37 CFR 1.97 and 1.98

Compressed gas and air operated turbine-type of vibrators are well known in the art. Some known examples are: U.S. Pat. No. 3,870,292 issued on Mar. 11, 1975; U.S. Pat. No. 3,932,057 issued on Jan. 13, 1976; U.S. Pat. No. 3,938,905 issued on Feb. 17, 1976; U.S. Pat. No. 4,389,120 issued Jun. 21, 1983; and U.S. Pat. No. 4,424,718 issued on Jan. 10, 1984 all of which have issued to the present inventor. Another known example of the prior art is U.S. Pat. No. 5,314,305 that issued to Fink on May 24, 1995.

Turbine-type vibrators are known for their efficient use of energy in the form of compressed gas or air. Turbine vibrators are also known for their relatively long life and quiet operation when compared to other types of vibrators. However, it has been determined that their is still a need to improve the efficiency of turbine type of vibrators while maintaining or improving their quiet operating characteristics. It has been determined that their is also a need to improve or increase the vibratory forces produced by turbine vibrators while maintaining a relatively compact size and weight.

The present invention solves the above identified needs by providing a turbine-type vibrator that is efficient, quiet, while providing more vibratory forces for a given size. The present invention as described below includes improvements in the design of the turbine as well as other improvements.

OBJECTS OF THE PRESENT INVENTION

The present invention may be characterized or described with respect to its objects. It is an object of the present invention to provide and it does provide a turbine-type vibrator that is efficient to operate.

It is another object of the invention to provide and it does provide a turbine-type vibrator that produces higher vibratory forces for a given size and while operating at a given pressure and flow of the compressed gas.

It is yet another object of this invention to provide and it does provide a turbine-type of vibrator that produces higher vibratory forces while providing noise levels at or below government or industry standards.

BRIEF SUMMARY OF THE INVENTION

One embodiment of the present invention may be briefly described as: a compressed gas or pneumatically actuated turbine-type vibrator including: (a) an outer housing having a cylindrical chamber formed therein; (b) a dynamically unbalanced rotor being freely rotatable within the cylindrical chamber while having a predetermined clearance therebetween, the rotor having a plurality of V-shaped or chevron shaped blades formed on its outer periphery, each V-shaped blade having a predetermined profile that includes a propelling surface; (c) at least one exhaust port being formed in and through the outer housing for allowing fluidic communication between the cylindrical chamber and an exterior of the outer housing; (d) an inlet port formed in said outer housing for allowing fluidic communication between the cylindrical chamber and a source of the compressed gas; and wherein said inlet port directs the compressed gas flowing therethrough to and towards the propelling surface of the V-shaped blade in close proximity thereto for generating vibratory forces as and when the rotor rotates The rotor of the present invention may be assembled from two halves for reducing the cost of manufacture. The blades or teeth may be formed with various profiles. The V-shaped configuration of the blades may have predetermined included angles for controlling the vibratory forces at given air pressures and flows. Orifices or passageways in the inlet port may be configured for controlling the frequency or speed of the turbine.

The frequency or speed of the turbine may be controlled by adjusting: (1) the air pressure and flow; (2) the included angle of the V-shape or chevron blade; (3) the tooth or blade profile; (4) the alignment of the inlet port passageway(s) or a combination thereof.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode of the present invention as presently known. These specific embodiments, as shown in the accompanying drawings, may also include diagrammatic symbols for the purpose of illustration and understanding.

BRIEF DESCRIPTION OF THE SEVERAL VIEWS OF DRAWINGS

Figure 1:
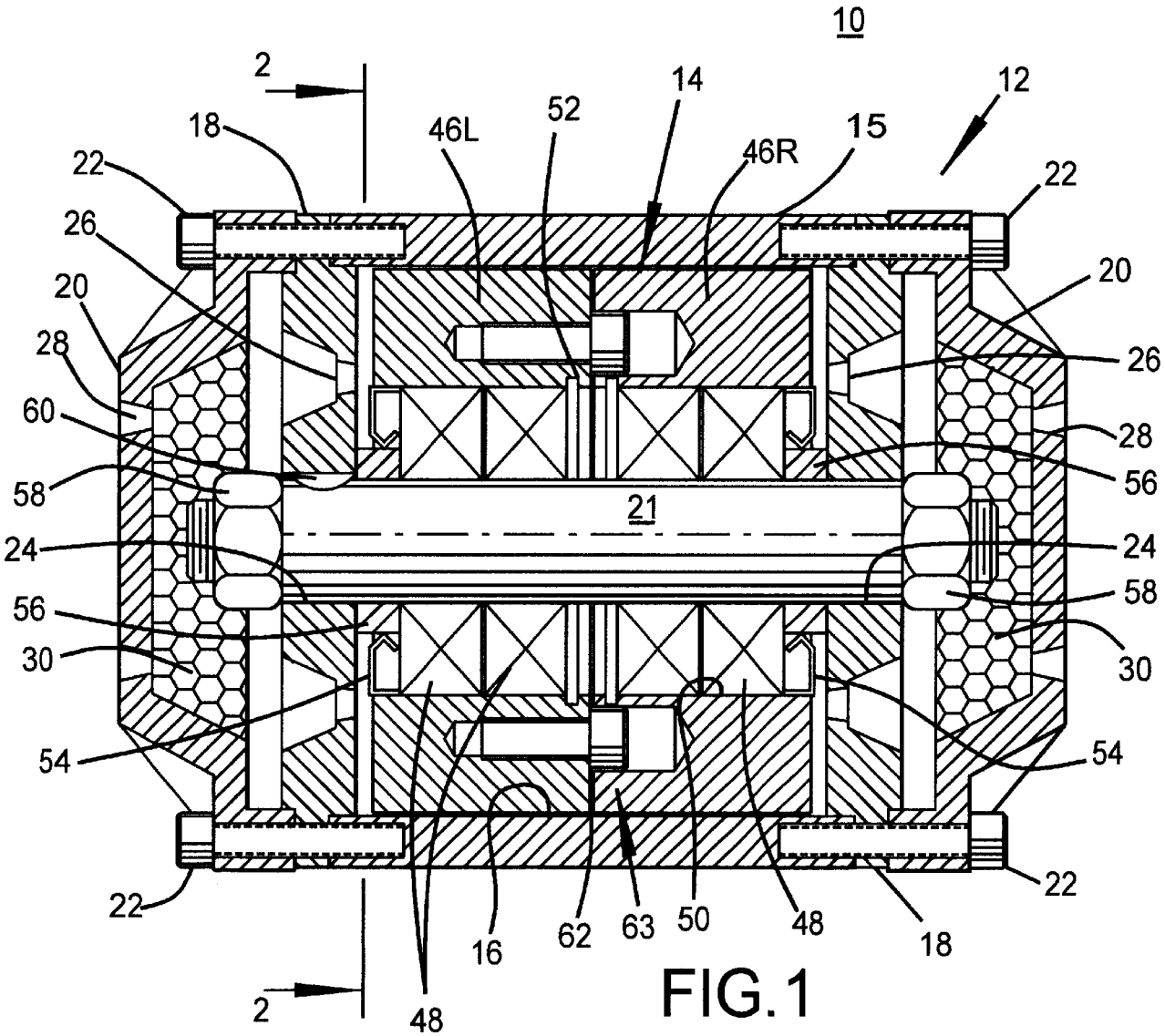
FIG. 1 represents a front elevation of a turbine-type vibrator of the present invention. This view being is section for showing the internal components thereof.

In the following description and in the appended claims, various details of construction and/or components are identified by specific names for convenience. These names are intended to be generic in their application while differentiating between the various components and details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown or described.

DETAILED DESCRIPTION OF THE INVENTION

Referring to FIGS. 1 through 4 of the drawings, a turbine-type of a vibrator assembly is generally identified as 10. The vibrator assembly 10 includes an outer housing 12 and a rotor assembly 14. The outer housing 12 includes a body portion 15, having a cylindrical chamber 16 formed therein, and a pair of end caps 18 removably attached thereto for enclosing the ends of cylindrical chamber 16. In a preferred embodiment, the outer housing 12 further includes a pair of cover members 20 that are also removably attached to body portion 15. A plurality of threaded bolts 22 are used for attaching the end caps 18 and the cover members 20. The rotor assembly 14 is supported by and retained on a shaft 21. The shaft 21 is supported by through apertures 24 formed in the end caps 18.

In the preferred embodiment shown in FIG. 1, at least one exhaust port 26 is selectively formed in at least one end cap 18 for allowing spent air or gas to escape from the cylindrical chamber 16. The exhaust port 26 should be sized for handling and passing of the spent gas there through absent any restriction. The total area or size of the exhaust port is dependent on the gas flow in C.F.M.'s (cubic feet per minute) that is expected to be consumed. One non-limiting arrangement of the exhaust ports 26 in each of the end caps 18 is four elongated apertures that are arrayed and formed along a common bolt circle. The cover members 20 also include a plurality of venting apertures 28 that are formed therein and there-through. It is preferred that a muffler pad 30 be provided in each of the cover members 20 for the muffling of the sound of the spent gas being exhausted through the exhaust ports 26 and prior to being emitted into the surrounding work environment.

Figure 2:
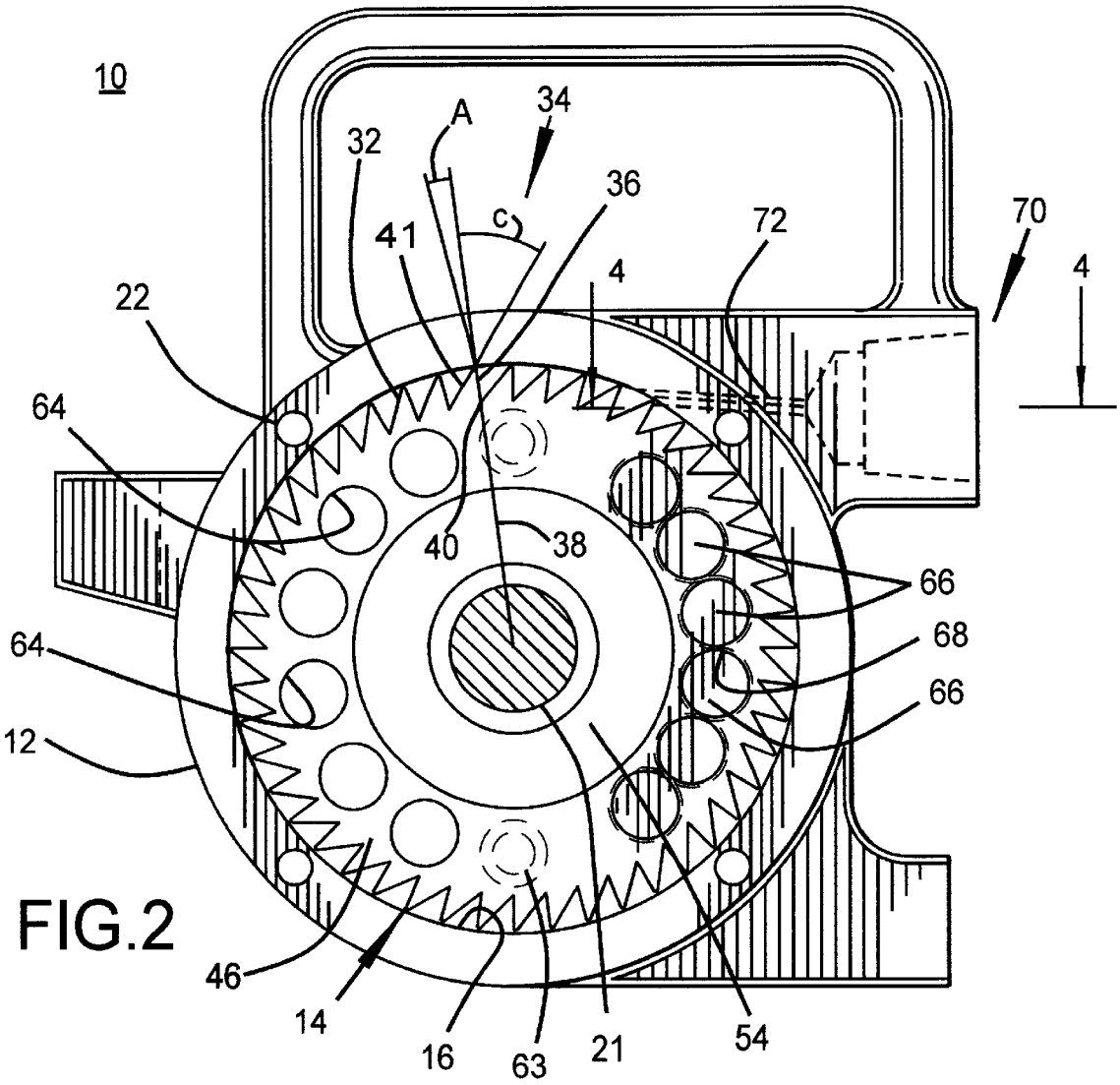
FIG. 2 represents a side sectional view thereof. This view being taken along line 2—2 of FIG. 1.
Figure 3:
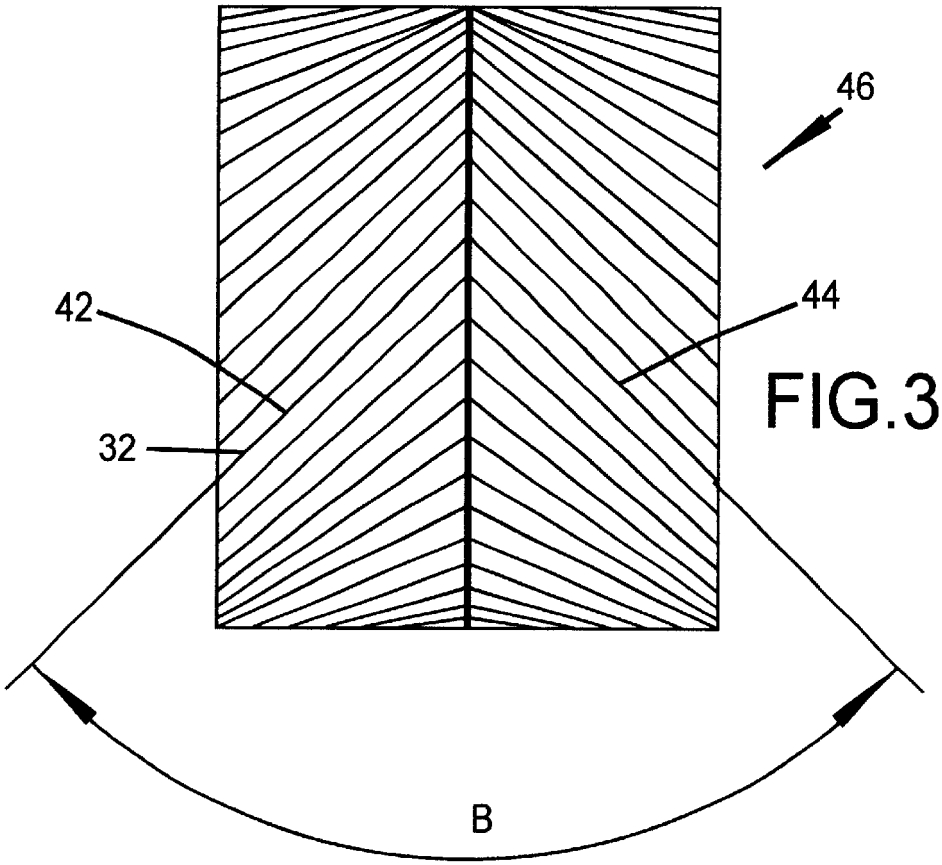
FIG. 3 represents a top elevation of the rotor or turbine of the present invention.

Referring now to FIGS. 2 and 3, the rotor assembly 14 has a plurality or blade members 32 formed along it periphery. It is preferred that each blade member 32 have a predetermined blade profile 34. One non-limiting example of a blade profile 34 is a saw-tooth-like profile, as seen in FIG. 2. The saw tooth profile has been found to provide high rotational speeds or frequency for the rotor assembly 14 while minimizing the sound associated therewith. It is preferred that a propelling surface 36 of the blade member 32 be formed at a predetermined angle A with respect to a theoretical radial line 38 that passes though the center of the rotor assembly 14 and a base point 40 of each propelling surface 36. The predetermined angle A should fall within the range between 0 and 10 degrees. It has been found that an angle at or near 0 degrees, as seen in FIG. 2, provides the highest speed at a given air pressure and flow while emitting moderate sound. Whereas, an angle A at or near 10 degrees provides a slightly slower speed and quieter sound at the same air pressure and flow. The leading surface 41 of the blade member 32 should be inclined at an angle C between the range of 40 and 50 degrees with the radial line 38 for minimizing resistance to rotation of the rotor assembly 14.

Referring now particularly to FIG. 3, each blade member 32 of the rotor assembly 14 of the present invention is formed in a chevron or V-shaped configuration, so that a predetermined included angle B is formed between each leg 42 and 44 of the blade member 32. It has been found that the included angle B should be within the range of 30 and 160 degrees. It has been found that an included angle of 90 degrees provides the best overall performance for most vibrator applications at a selected air pressure and flow. Whereas, included angles B approaching 160 degrees produce the lower speeds at the same selected air pressure and flow.

Referring now to FIGS. 1 through 3, the rotor assembly 14 includes a rotor wheel member 46 that is carried and retained by the shaft 21. In a preferred arrangement, the rotor wheel 46 is journaled on the shaft 21 by a plurality of anti-friction bearings 48. In this preferred example, the anti-friction bearings 48 are pressed into a bore 50 of the rotor wheel 46 and retained therein by a suitable retaining device such as shoulder, an external retaining ring 52 (seen in FIG. 1) or the like. It is preferred that a shaft seal 54 be provided at each end of the rotor assembly 14 for limiting any contaminants from entering or leaving the interior of the rotor assembly 14. In the preferred construction, a shaft spacer 56 is provided for locating the rotor assembly 14 within the cylindrical bore 16. Arbor shims, not shown, may be used in conjunction with the spacers 56 for correcting and rotor misalignment, or for filling of any spacers and/or gaps resulting from machining tolerances. In this preferred mounting arrangement axial movement of the shaft 21, with respect to the end caps 18, be maintained by threaded nuts 58. It is also preferred that a anti-rotation device such as a key 60 and keyseat arrangement, a anti-rotation pin and the like be provided between the shaft 21 and at least one end cap 18. It has been found that using currently known forming and or machining techniques it is less costly to form a rotor wheel member 46 using a RH wheel portion 46R and a LH wheel portion 46L as may be seen in FIG. 1. In this two piece construction, a sealing device 62 such as a gasket, O-ring and the like is placed between the RH wheel portion 46R and the LH wheel portion 46L for limiting the passage of a compressed gas there-between. A clutch device 63 having at least one driving member should be mounted between the LH wheel portion and the RH Wheel Portion for maintaining speed synchronization and tooth or blade alignment between the RH wheel portion 46R and the LH wheel portion 46L. The clutch device 63 may include a pin, or screw head in the LH wheel portion 46L cooperating with a mating bore in the RH wheel portion 46R. It is anticipated, that the V-shaped configuration of the blade members 32 may be formed or molded on a single rotor wheel member 46. It is also anticipated that the rotor wheel 46 may be fixed to the shaft 21 while the anti-friction bearings are housed in each of the end caps 18.

Referring now in particular to FIG. 2, the rotor wheel 46 is dynamically unbalanced by reducing the weight thereof along a selected segment or portion. The weight reduction may be made by forming or drilling a plurality of through lightening apertures 64 therein. This reduction of weight alone will provide a dynamically unbalanced rotor wheel. However, in order to increase the vibratory forces it has been found that providing the rotor wheel 46 with a filler material 66 that is heavier than the base rotor material and along a segment opposite to the lightening apertures 64. This arrangement will increase the dynamic unbalancing characteristics of the rotor wheel 46. One non-limiting example of a filler material 66 is a heavy metal such as lead. The filler material 66 preferably is molded into undercut apertures 68 that are formed in the rotor wheel 46.

Figure 4:
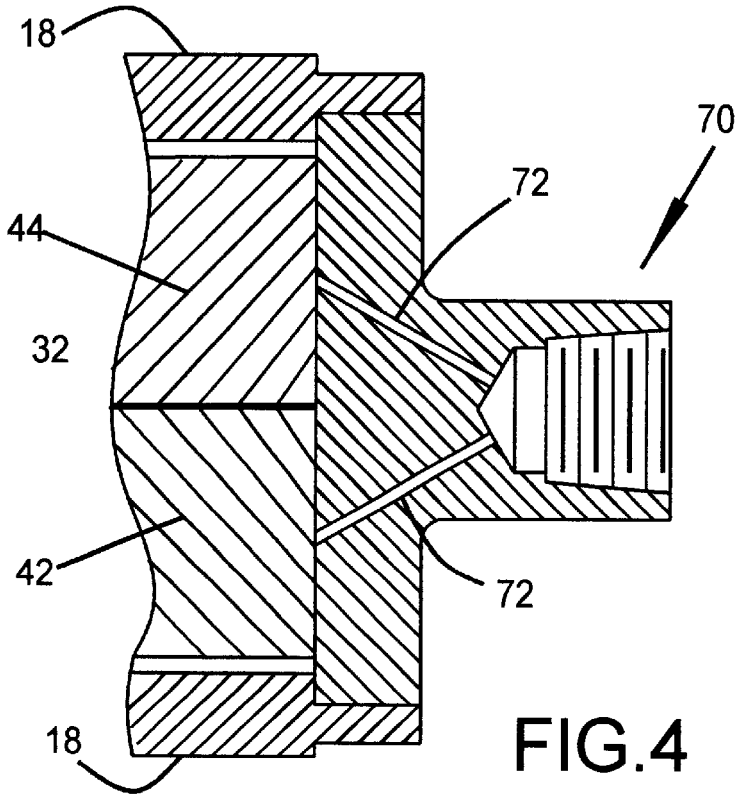
FIG. 4 represents a section view of an alternated port configuration. This view being taken in the direction of arrows 4—4 in FIG. 2.

Referring now to FIGS. 2 and 4, one type of portable vibrator assembly 10 is depicted. This type of vibrator is configured for being removably placed into a quick release bracket that is permanently attached to an article to be vibrated. The outer housing 12 includes an inlet port 70 that is adapted to receive a conduit or fitting, not shown, for a compressed gas or air. The inlet port 70 includes at least one orifice or passageway 72. It is preferred that the orifice or passageway 72 be aligned with the blade profile 34 so that the stream of compressed gas contact the propelling surface 36 between 70 and 90 degrees. It has been found that an angle at or near 90 degrees provides the best results. The axis of the orifice 72 may be positioned at an angle with respect to the centerline or axis of the inlet port 70 for providing the desired alignment. The inlet port 70 should have a passageway 72 that is sized for allowing the flow of a compressed gas at a predetermined pressure and flow. Alternatively the inlet port 70 may include two diverging passageways 72 that are directed at each leg 42 and 44 of the V-shaped blade member 32.

One non-limiting example of a vibrator assembly 10 of the present invention includes an outer housing 12 having a cylindrical bore 50 that is 12.7 cm (5.0 in) in diameter ×15.88 (6.25 in) Ig. A rotor assembly 14 is freely rotated therein with predetermined clearances. Some non-limiting examples of these clearances are: Radial (0.025–1.5 MM) and End (0.05–3.0 mm). The rotor assembly 14, having 48 blades and arrayed in a chevron or V-shape having an include angle B of 90 degrees and a blade profile 34 having a predetermined angle A of 0 degrees and Angle C of 45 degrees, will develop a force of 31,143 N (7000 lbs.) at 80 PSIG and 45 C.F.M. while providing a noise level at or below industry or government standards. A conventional rotor or turbine assembly 14 having a standard tooth profile and having a straight blade will develop a force of 22245 N (5000 lbs.) at 80 PSIG and 45 C.F.M.

It can be easily seen from the above example that the present invention will provide improved and efficient performance at a given pressure and flow of a compressed gas. This improved performance for a give size vibrator improves efficiency while allowing greater forces to be developed for smaller sizes of vibrators. It is believed that the principles described above may be used with vibrators of various sizes and with various inlet and outlet port configurations Directional terms such as "front", "back", "in", "out", "downward", "upper", "lower" and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A compressed gas actuated turbine-type vibrator including:

(a) an outer housing having a cylindrical chamber formed therein;

(b) a dynamically unbalanced rotor being freely rotatable within the cylindrical chamber while having a predetermined clearance there-between, the rotor having a plurality of V-shaped blades formed on its outer periphery, each V-shaped blade having a predetermined profile that includes a propelling surface; the rotor including a right hand portion and a left hand portion, the right hand portion having one leg of the V-shaped blade formed thereon, the left hand portion having a second leg of the V-shaped blade formed thereon, the rotor further including a gasket member disposed between adjacent surfaces of the right hand portion and the left hand portion for minimizing a flow of the compressed gas between the right hand portion and the left hand portion (c) at least one exhaust port being formed in and through the outer housing for allowing fluidic communication between the cylindrical chamber and an exterior of the outer housing;

(d) an inlet port formed in said outer housing for allowing fluidic communication between the cylindrical chamber and a source of the compressed gas; and wherein said inlet port directs the compressed gas flowing therethrough to and towards the propelling surface of the V-shaped blade in close proximity thereto for generating vibratory forces as and when the rotor rotates within the outer housing.

2. A vibrator as recited in claim 1 wherein said inlet port further includes at least one air passage each air passage having a longitudinal axis that is formed at a predetermined angle with respect to the propelling surface of an adjacent one of the V-shaped blades for directing the compressed gas to and toward a selected point on the propelling surface.

3. A vibrator as recited in claim 1 said inlet port further includes at least two air passages, each air passage having a longitudinal axis that is formed at a predetermined included angle with respect to the propelling surface of an adjacent one of the V-shaped blades for directing the compressed gas to and toward a selected point on the propelling surface.

4. A vibrator as recited in claim 1 wherein the right hand portion and the left hand portion of the rotor are freely journaled on a stationary shaft and the rotor including at least one coupling member for ensuring that the right hand portion and the left hand portion rotate at the same speed.

5. A vibrator as recited in claim 2 wherein the right hand portion and the left hand portion of the rotor are freely journaled on a stationary shaft and the rotor including at least one coupling member for ensuring that the right hand portion and the left hand portion rotate at the same speed for maintaining a selective alignment of the V-shaped blades.

6. A vibrator as recited in claim 3 wherein the right hand portion and the left hand portion of the rotor are freely journaled on a stationary shaft and the rotor further including at least one coupling member for ensuring that the right hand portion and the left hand portion rotate at the same speed for maintaining a selective alignment of the V-shaped blades.

7. A vibrator as recited in claim 1 wherein each propelling surface is a flat plane that is formed at a selected angle with respect to a radial line passing through a center of the rotor and base point of each propelling surface.

8. A vibrator as recited in claim 2 wherein each propelling surface is a flat plane that is formed at a selected angle with respect to a radial line passing through a center of the rotor and base point of each propelling surface.

9. A vibrator as recited in claim 3 wherein each propelling surface is a flat plane that is formed at a selected angle with respect to a radial line passing through a center of the rotor and base point of each propelling surface.

10. A vibrator as recited in claim 4 wherein each propelling surface is a flat plane that is formed at a selected angle with respect to a radial line passing through a center of the rotor and base point of each propelling surface.

11. A vibrator as recited in claim 5 wherein each propelling surface is a flat plane that is formed at a selected angle with respect to a radial line passing through a center of the rotor and base point of each propelling surface.

12. A vibrator as recited in claim 6 wherein each propelling surface is a flat plane that is formed at a selected angle with respect to a radial line passing through a center of the rotor and base point of each propelling surface.

* * * * *